US006553746B1

(12) United States Patent
Cere'

(10) Patent No.: US 6,553,746 B1
(45) Date of Patent: Apr. 29, 2003

(54) DEVICE FOR AUTOMATICALLY CHANGING REELS OF FILM

(75) Inventor: Mauro Cere', Loiano (IT)

(73) Assignee: Aetna Group, S.p.A., Rimini (IT)

( * ) Notice: Subject to any disclaimer, the term of this patent is extended or adjusted under 35 U.S.C. 154(b) by 110 days.

(21) Appl. No.: 09/692,921

(22) Filed: Oct. 20, 2000

(30) Foreign Application Priority Data

Nov. 5, 1999 (IT) ..... B099A0598

(51) Int. Cl.[7] ..... B65B 13/04
(52) U.S. Cl. ..... 53/589; 53/389.1
(58) Field of Search ..... 53/589, 389.1, 53/389.2; 242/559.3, 559.4

(56) References Cited

U.S. PATENT DOCUMENTS

| | | | | |
|---|---|---|---|---|
| 4,718,219 A | * | 1/1988 | Schmitz | 53/211 |
| 4,914,891 A | * | 4/1990 | Suolahti | 53/389.1 |
| 5,400,567 A | * | 3/1995 | Lindstrand | 242/608.4 |
| 5,562,385 A | * | 10/1996 | Tacchi et al. | 242/559.4 |
| 6,276,116 B1 | * | 8/2001 | Annila et al. | 53/211 |

FOREIGN PATENT DOCUMENTS

| | | |
|---|---|---|
| DE | 19601668 | 7/1997 |
| EP | 293352 | 11/1988 |
| EP | 811554 | 12/1997 |

* cited by examiner

*Primary Examiner*—Rinaldi I. Rada
*Assistant Examiner*—Hemant M. Desai
(74) *Attorney, Agent, or Firm*—Fay, Sharpe, Fagan, Minnich & McKee, LLP

(57) ABSTRACT

A device for changing reels of film on machines for wrapping products comprises a unit for substituting a finished reel with a new reel, the unit being mobile between a non-operating position in which it is distanced from an operating zone of a ring-shaped structure, and an operating position, in which it is close to the operating zone and to a wrapping unit; the unit comprises first means for detaching and picking up the finished reel from a support shaft, a magazine zone for at least one new or replacement reel which can be stably attached to the support shaft, second means for picking up the free end of film from the replacement reel and mobile along a path covering a preset film path, to allow film positioning close to a product to be wrapped.

21 Claims, 8 Drawing Sheets

14
25
26b
26
26a
2a
1
F25
26
24
23
Z21
26b
26
C
8
1e
22
24
19
20
26a
21
2a
31
29
32
18
27a
27b
15
33
12
13
19
8b
F8
8
1e
F8
8a 27a
27b
30
33
28
29
20
15
P1
22b
24
27
22
F22
23
22
30
5
13
7
22a
19
24
8
12
31
31b
21
2a
15
7
31a
31
8
1
25
26
26b
2a
26a
2a
18
26a
26b
F25
14

DEVICE FOR AUTOMATICALLY CHANGING REELS OF FILM

BACKGROUND OF THE INVENTION

The present invention relates to a device for automatically changing reels of film, in particular stretch and/or shrink-wrap films, in machines which wrap products on pallets.

At present, one such machine for wrapping products comprises a frame which consists of a vertical column designed to support a ring, extending horizontally and mobile vertically in both directions, with a unit for wrapping products on pallets which are positioned at the base of the machine.

The ring moves vertically, surrounding the products so as to allow the unit to distribute the film completely around the products, thanks to the fact that it can rotate along the ring powered by relative drive means.

The wrapping unit basically comprises a support plate for a reel holder shaft, which turns freely, at least one pair of film pre-stretching rollers, one or more film feed rollers which guide it towards a so-called <<dandy>> roller (outside the wrapping unit), designed to allow the film to be distributed around the products correctly.

Such machines have proved highly productive in terms of time, but one of the operations which are relatively slow and, above all, difficult for machine operators is substituting the finished reel with a new reel. This is generally done manually by the operator who stops the machine, removes the cardboard core of the finished reel and fits a new reel on the shaft by inserting from the bottom upwards. The operator must then position the initial length of film along the path defined by the unit rollers as far as a gripper fixed to the ring, to allow initial film unwinding during the first few unit rotations along the ring.

Obviously, this operation is usually repeated several times in a short period, affecting the continuity of product wrapping, since lifting and positioning the new reels is difficult and time-consuming.

To reduce the reel change-over time, there is a device which is independent of the wrapping machine and consists of a carriage which moves towards and away from the ring. Said device is equipped with a sort of carrousel divided into two separate zones, the first with a wrapping unit complete with rollers and the new reel, and the second zone which is clear and ready to pick up the unit just used. In practice, when the reel on the machine finishes, the unit is stopped and the carriage brought under the unit fitted on the ring with the clear zone located below the unit; the ring is then lowered to allow the unit to rest on the carriage and detach from the ring. Following this operation, the carrousel is turned through 180° so that the unit with the new reel is positioned below the support plate, to which the unit is then attached.

This device on one hand reduces the work of the machine operator, but on the other hand increases the cost of the machine, since at least one pair of (expensive) wrapping units is required for each machine. In addition, it should be considered that not all wrapping units have a simple structure and roller positioning which allows this type of automated solution.

SUMMARY OF THE INVENTION

The aim of the present invention is to eliminate this type of disadvantage, by providing a device for automatically changing reels of film for wrapping products extremely rapidly, which is reliable and relatively economical as a whole.

BRIEF DESCRIPTION OF THE DRAWINGS

The technical features of the present invention, in accordance with the aforesaid aims, are clearly illustrated in the claims herein, and the advantages of the invention are more clearly shown in the detailed description below, with reference to the accompanying drawings which illustrate a preferred embodiment of the invention without limiting its scope of application and in which.

DESCRIPTION OF THE PREFERRED EMBODIMENTS

Figure 1:
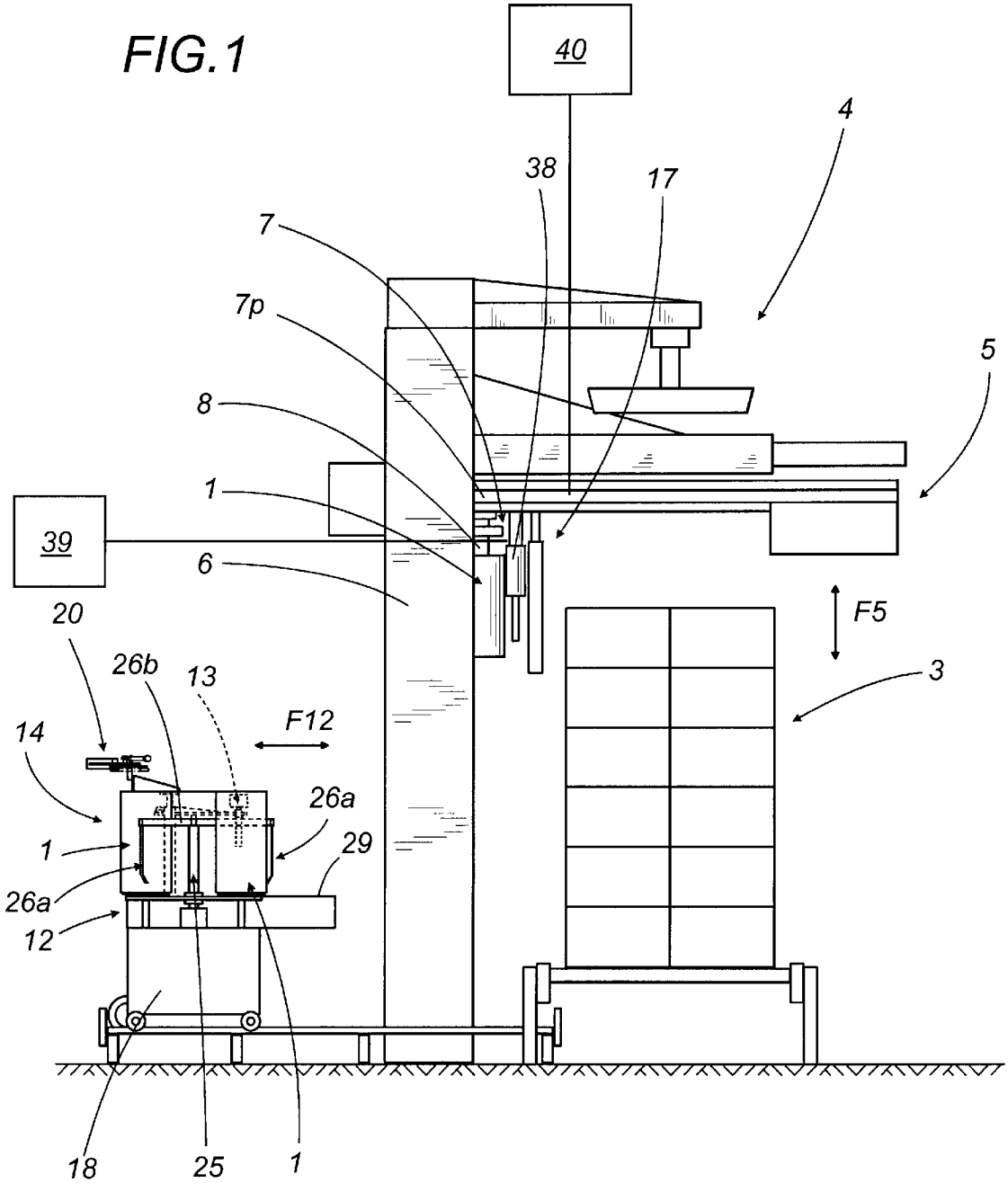
FIG. 1 is a schematic side view of a machine for wrapping products with plastic film, equipped with the reel changing device made in accordance with the present invention.

With reference to the accompanying drawings, and in particular FIG. 1, the device disclosed is used to automatically change reels 1 of film 2 for wrapping products 3.

These reels 1 of film 2 are used on machines 4 which wrap products 3 on pallets, normally stacked on top of one another. These machines 4 have a ring structure 5 which is vertically mobile in both directions (see arrow F5 in FIG. 1), along a vertical support column 6.

The ring 5 is equipped with a product 3 wrapping unit 7, which moves along the ring to allow spiral wrapping of products 3 with the film 2. This unit 7 normally comprises an freely rotating shaft 8 which supports the reel 1, a pair of film 2 pre-stretching rollers 9 and 10 close to the shaft 8, and a pair of rollers 11 and 11*a* which feed the film 2 to a roller 110 (known to experts in the field as a <<dandy roller>>), defining a preset film 2 path P from the reel 1 to the product 3 to be wrapped (see, in particular, FIGS. 2 and 3).

Figure 5:
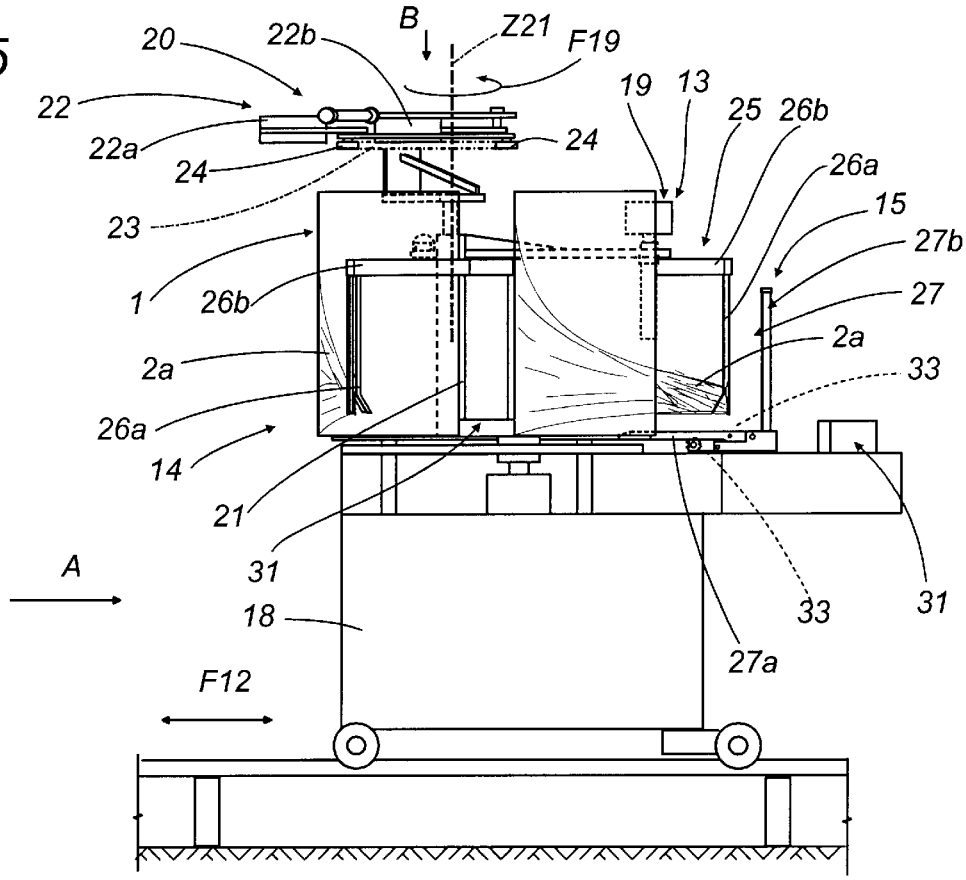
FIG. 5 is a schematic side view of the device in FIG. 1, with some parts cut away to better illustrate others.

FIGS. 1 and 5 show the presence at the base of the wrapping machine 4 of a unit 12 which substitutes a finished reel 1*e* with a new reel 1. The finished reel 1*e* is the cylindrical cardboard core which supports the film 2.

This unit 12 is mobile (see arrow F12 in FIG. 5) between a non-operating position, in which it is distanced from a ring 5 operating zone, and an operating position, in which it is close to the operating zone and the wrapping unit 7 (position illustrated in FIG. 5).

The unit 12 basically comprises first means 13 for picking up and detaching the finished reel 1*e* from the shaft 8; a magazine zone 14 for at least one new or replacement reel 1 which can be stably attached to the support shaft 8, and second pick up means 15 for the free end 2*a* of the film 2 from the replacement reel 1, said second means 15 being mobile along a path P1 which substantially covers the preset film 2 path P, allowing the film 2 to be positioned close to the product 3 to be wrapped.

In addition to the above-mentioned elements, there are shaft 8 drive means 16. These means 16 allow the shaft 8 to be moved away from the pre-stretching rollers 9 and 10 during substitution of the finished reel 1*e* with a new reel 1. The shaft 8 can also be moved towards the pre-stretching rollers 9 and 10 upon completion of the reel change. This is necessary (again see FIGS. 2 and 3) because, during the operating stages, the reel 1 is continuously in contact with one of the two pre-stretching rollers 9 and 10.

Figure 2:
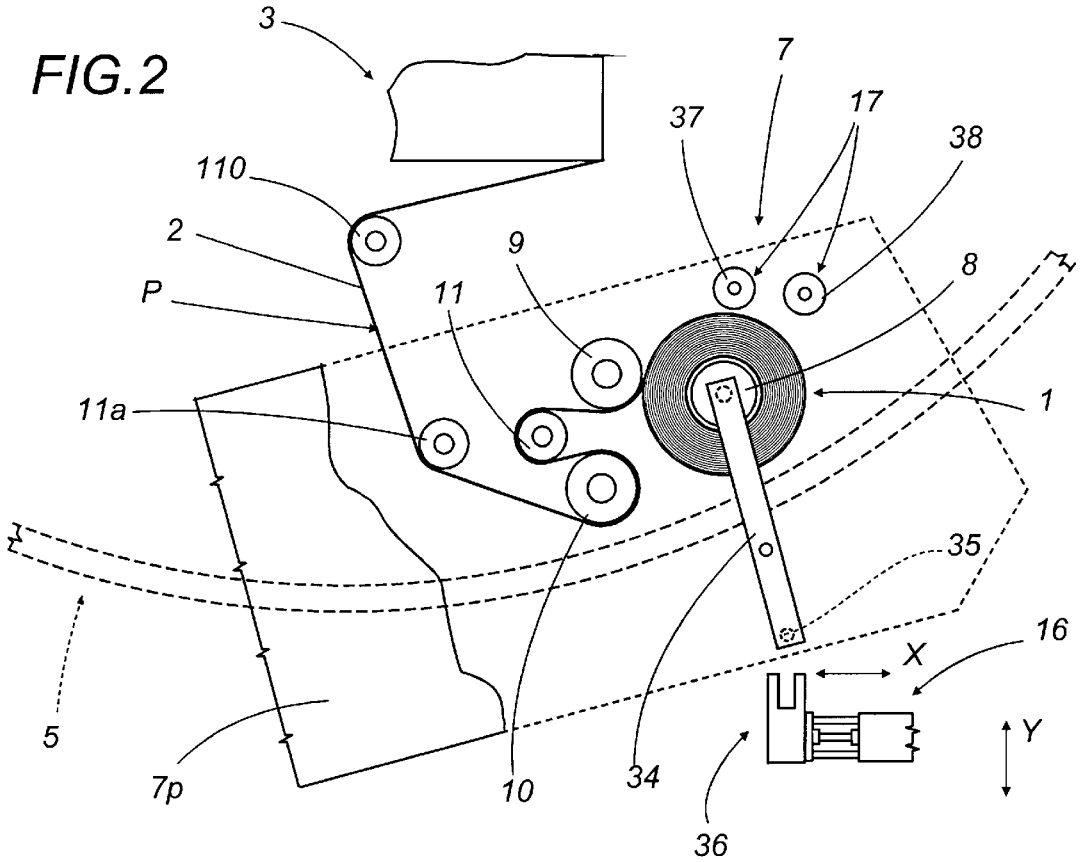
FIGS. 2 and 3 are schematic top plan views of a wrapping unit fitted with part of the reel changing device disclosed, in two operating configurations.
Figure 3:
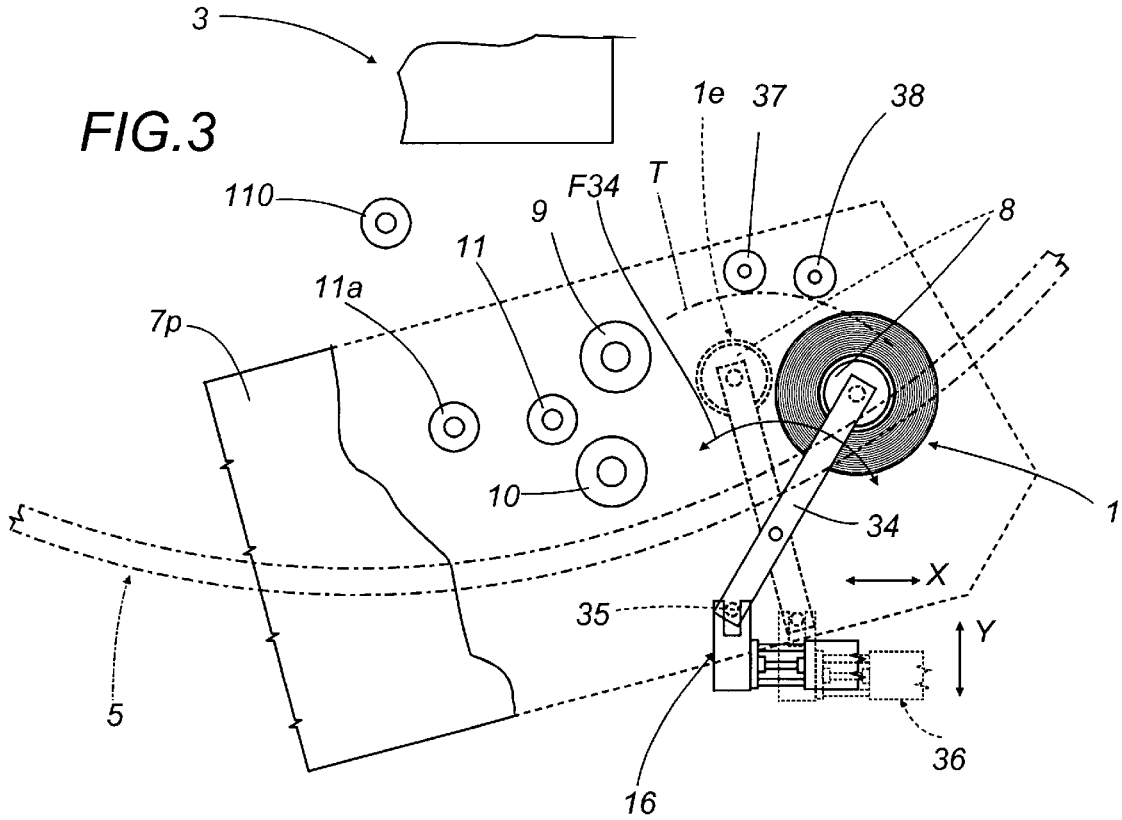
Figure 4:
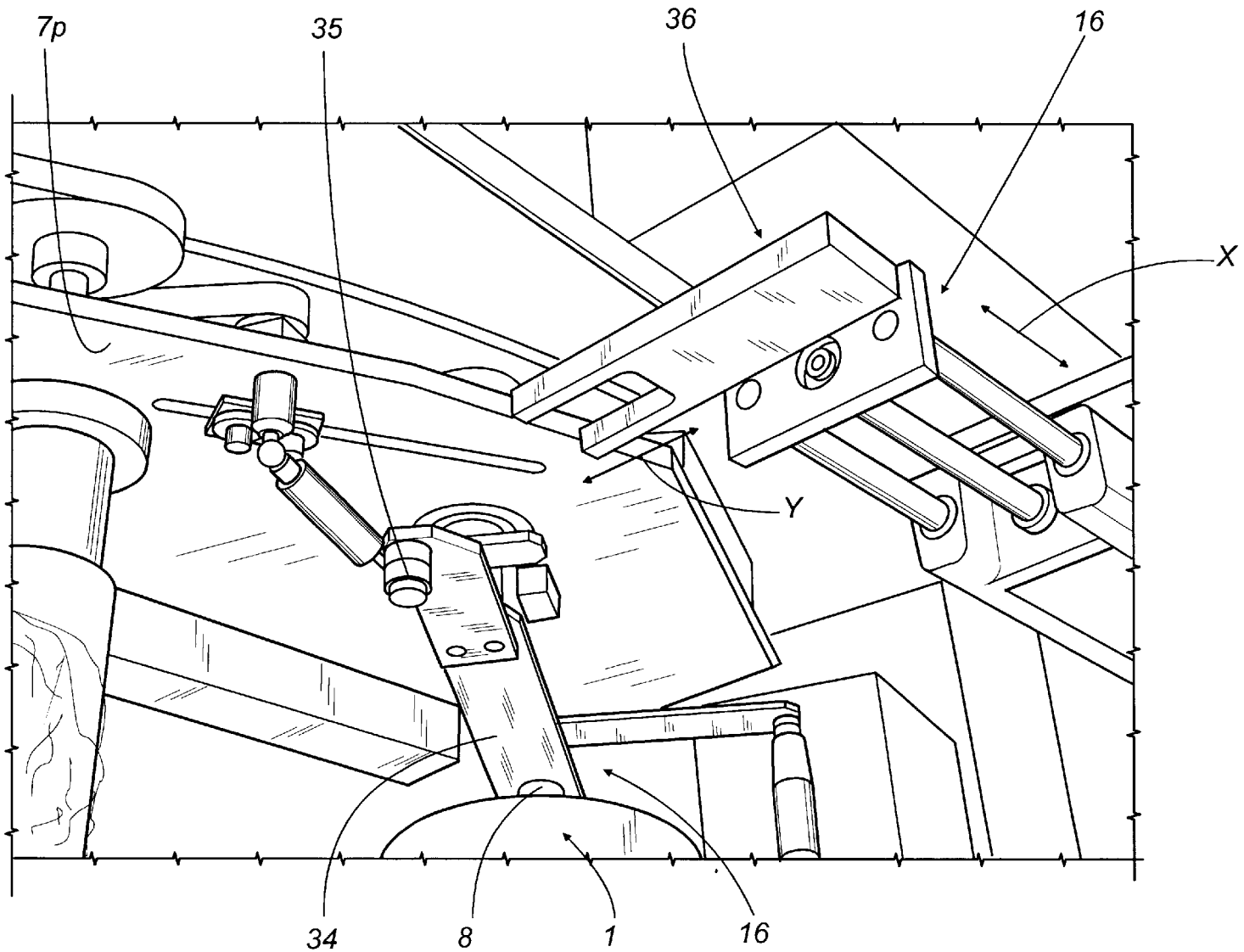
FIG. 4 is a perspective view of a detail of the device with reference to FIGS. 2 and 3.

More specifically, again see FIGS. 2 and 3 and FIG. 4, the above-mentioned shaft 8 drive means 16 comprise a horizontal arm 34 which pivots on the wrapping unit 7 comprising a support plate 7*p* for all of the elements.

The shaft 8 is attached to the arm 34, whilst the free end of the arm 34 is fitted with a vertical pin 35 which can engage with a gripper element 36 on the vertical column 6, mobile along two controlled axes (labeled X and Y) and designed to allow the arm 34 to rotate in such a way that it moves the shaft 8 with the finished reel 1*e* away from, and respectively, moves the shaft 8 with the new reel 1 towards the pre-stretching rollers 9 and 10 (see arrows F34).

Returning to the unit 12, it is equipped with a motor-driven support carriage 18 which slides in both directions, allowing it to be positioned below the ring 5 and close to the wrapping unit 7.

This movement of the unit 12 allows its various components to be positioned according to the preset methods for changing the finished reel 1*e*.

To allow the release of the finished reel 1*e*, there must be two elements which constitute the above-mentioned first pick up and detachment means 13. To support the reel 1, the reel support shaft 8 is fitted with a pair of reel 1 retaining elements 8*a* and 8*b* (clearly illustrated in FIG. 6). These elements 8*a* and 8*b* can be turned between a position in which they lock the reel in place, where the elements 8*a* and 8*b* project in a radial direction from the lower end of the shaft 8 (position illustrated with the continuous line in FIG. 6), and a release position, in which the elements 8*a* and 8*b* are turned towards the shaft 8 (position illustrated with the dashed line in FIG. 6 and with the arrow F8).

Figure 8:
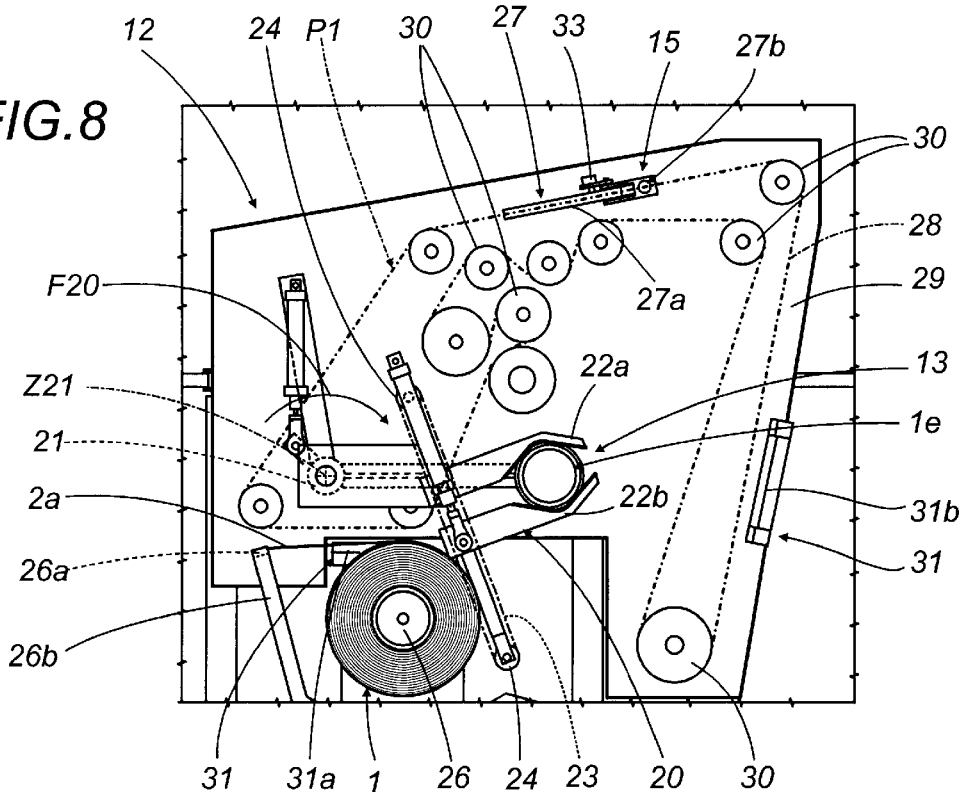
FIG. 8 is a partial top plan view of a detail, that is to say, the pick up means for the finished reel, which are part of the device illustrated in FIG. 6.

In order to release and pick up the finished reel 1*e*, the above-mentioned finished reel 1*e* pick up and detachment means 13 comprise (see FIGS. 6 and 8) a cup-shaped element 19 for releasing the retaining elements 8*a* and 8*b*, and a finished reel 1*e* pick up unit 20, designed to allow the reel to be removed from the shaft 8 when the elements 8*a* and 8*b* have been released.

More specifically, the cup-shaped element 19 and the pick up unit 20 are supported by a single column 21 and rotate independently about a single vertical axis Z21 between a position in which they are distanced from the shaft 8 and a position in which they are close to the shaft 8 (see also arrows F19 and F20).

The size and shape of the inside of the cup-shaped element 19 are such that, when in the position close to the shaft, it houses the lower part of the shaft 8 with the relative part of the finished reel 1*e*, in a first position of the unit 7 along the ring 5 and subsequent vertical movement of the support ring 5. In this way, thanks to the contact with the internal surface of the cup-shaped element 19, the retaining elements 8*a* and 8*b* are moved to the aforementioned position in which they release the finished reel 1*e*.

At this point the pick up unit 20 is activated. This unit consists of a gripper 22 comprising two independent jaws 22*a* and 22*b*, set opposite one another and shaped in such a way that they surround the finished reel 1*e*. The jaws 22*a* and 22*b* (clearly illustrated in FIG. 8) are attached to an endless chain 23 wound around two gear wheels 24 and driven in such a way as to allow movement of the jaws 22*a* and 22*b* towards and away from each other (see arrow F22). When the gripper 22 has grasped the finished reel 1*e*, the ring 5 and shaft 8 are raised again, allowing complete removal of the finished reel 1*e*.

Figure 7:
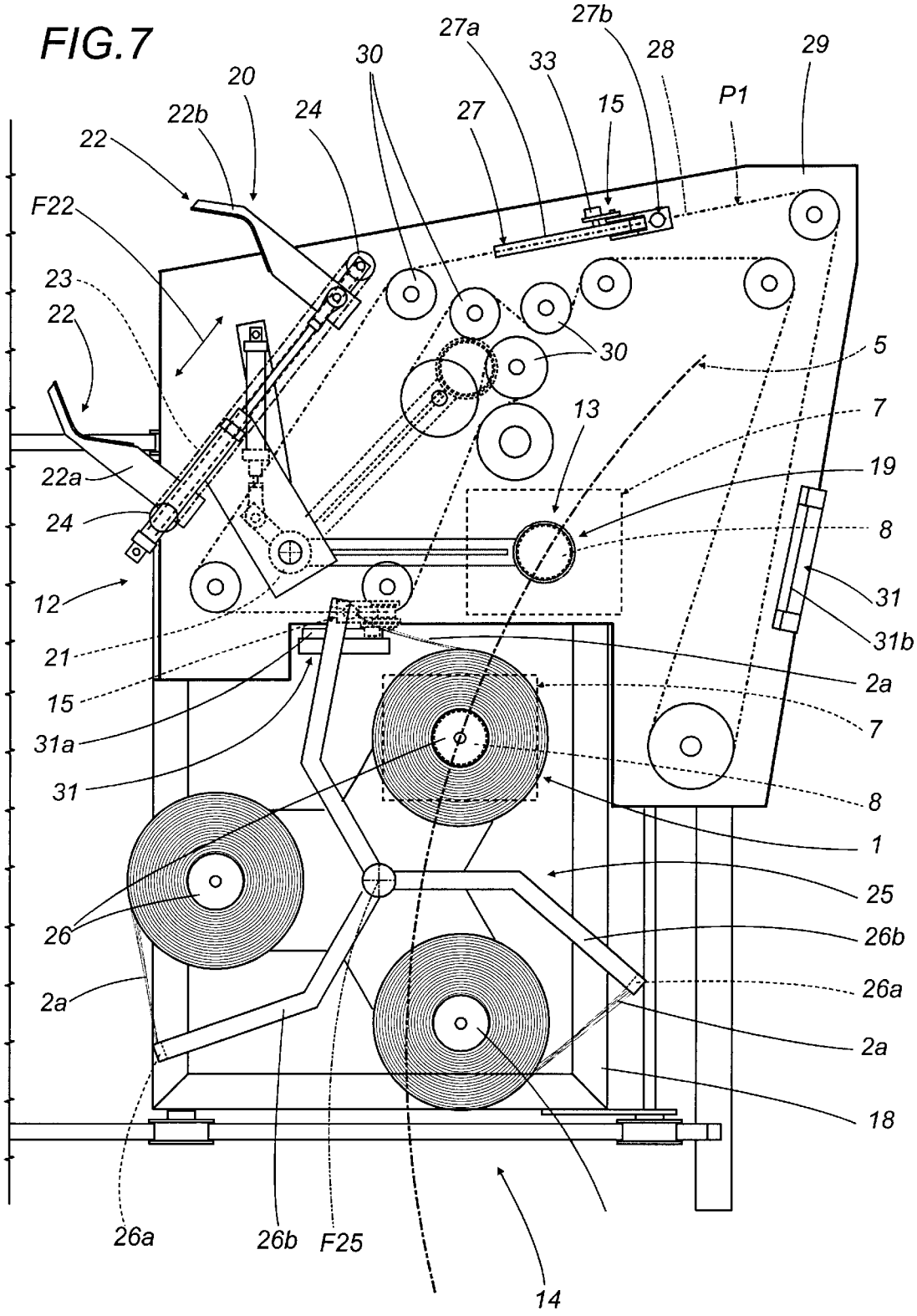
FIG. 7 is a schematic view from B in FIG. 5 of the device illustrated in FIG. 5.

At the side of the pick up unit 20, there is the magazine zone 14, comprising a carrousel 25 which rotates about its vertical axis (see arrow F25 in FIG. 7) and is designed to allow co-axial positioning of the new reel 1 and the support shaft 8.

In the preferred embodiment illustrated, without limiting the scope of the invention, the carrousel 25 comprises three vertical support pins 26 for new reels 1. Each pin 26 is vertically mobile in both directions, between a raised operating position (illustrated in FIG. 5) supporting the reel 1, and a lowered non-operating position (illustrated in FIG. 6), simultaneous with lowering of the shaft 8, allowing attachment of the shaft 8 and the new reel 1 and locking by the retaining elements 8*a* and 8*b*. Obviously, the shaft 8 is positioned above the new reel 1 by moving the wrapping unit 7 following removal of the finished reel 1*e*.

In addition to the pins 26, for each new reel 1 the carrousel 25 comprises a fixed gripper 26*a* for positioning the free end 2*a* of the film 2 in a zone in which the above-mentioned pick up means 15 intercept the free end 2*a* when the new reel 1 is attached to the shaft 8. In practice, a supporting structure 26*b* connects each pin 26 to the gripper 26*a* which, when the new reel 1 is positioned for pick up by the shaft 8, moves the free end 2*a* to a zone in which it is picked up by the second pick up means 15 (described in detail below).

The second pick up means 15 comprise (see FIGS. 6 and 7) a gripper 27 for picking up the free end 2*a*, the gripper being attached to an endless, motor-driven chain 28 which extends along a horizontal surface 29 of the unit 12 next to the magazine zone 14 and below the first pick up means 13.

The chain 28 extends along the path P1 covering the preset film 2 path P over a plurality of drive gear wheels 30, with which the chain 28 meshes. The gear wheels 30 are suitably positioned along the horizontal surface 29 in such a way as to partially cover the surfaces of the rollers 9, 10, 11, 11*a* and 110 on the wrapping unit 7 (again see FIG. 7, which illustrates overlapping of the wheels 30 and the rollers of the wrapping unit 7).

Figure 10:
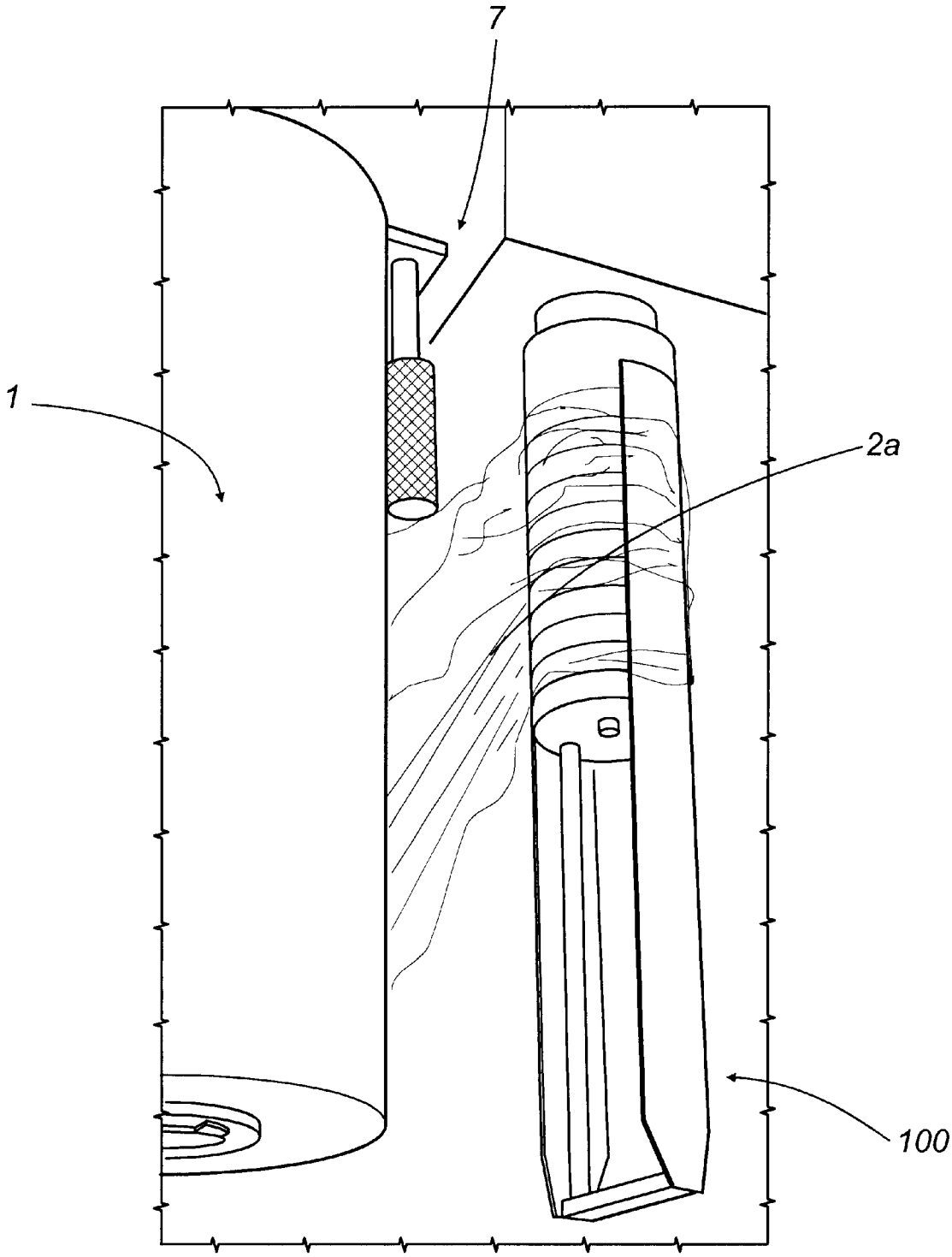
FIG. 10 is a perspective view, with some parts cut away to better illustrate others, of a pick up gripper for a free end of film applied to the machine.

The gripper 27 may be closed to lock the free end 2*a* in place, or opened to release the free end 2*a* by cam means 31 located on the unit 12 at points close to the path P1 followed by the gripper. The gripper 27 is closed next to the zone in which the free end 2*a* of the film 2 is positioned by the gripper 26*a*, whilst the free end 2*a* is released by opening the gripper 27 at an end zone of the preset film 2 path P1. The end zone of the path P1 is longer than the operating path P, to allow a film 2 winding stroke about a gripper element 100 in a fixed position on the machine 4 (see FIG. 10) and designed to allow the definition of a starting point for product 3 wrapping. That is to say, it keeps the free end 2*a* in one place for at least a set of movements wrapping the film 2 around the product 3, then releases the free end 2*a*.

Returning to the above-mentioned cam means 31, these consist of two identical but separate cam profiles 31*a* and 31*b*. The first, closing cam 31*a* is positioned in such a way that it can be inserted between the magazine 14 and the horizontal surface 29, close to the fixed gripper 26*a* for positioning the free end 2*a*. The second, opening cam 31*b* is positioned at an end zone of the path P1 followed by the pick up gripper 27.

Figures 6, 6A:
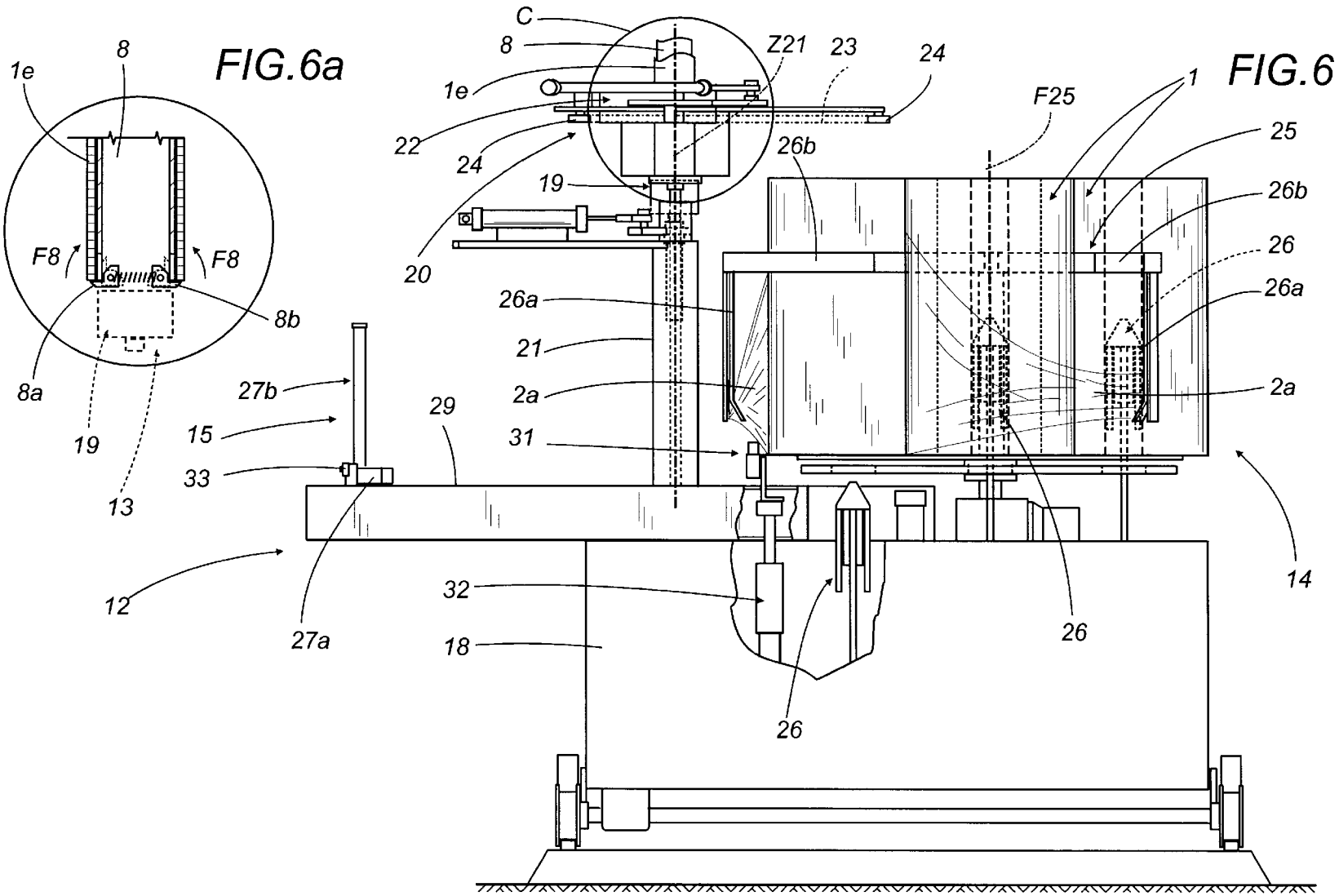
FIG. 6 is a schematic view of the device in FIG. 5, seen from A relative to FIG. 5 and with the pick up means which are part of the device in a different operating stage.
FIG. 6*a* is a front view of a detail C from FIG. 6, with some parts in cross-section and other parts cut away.
Figure 9:
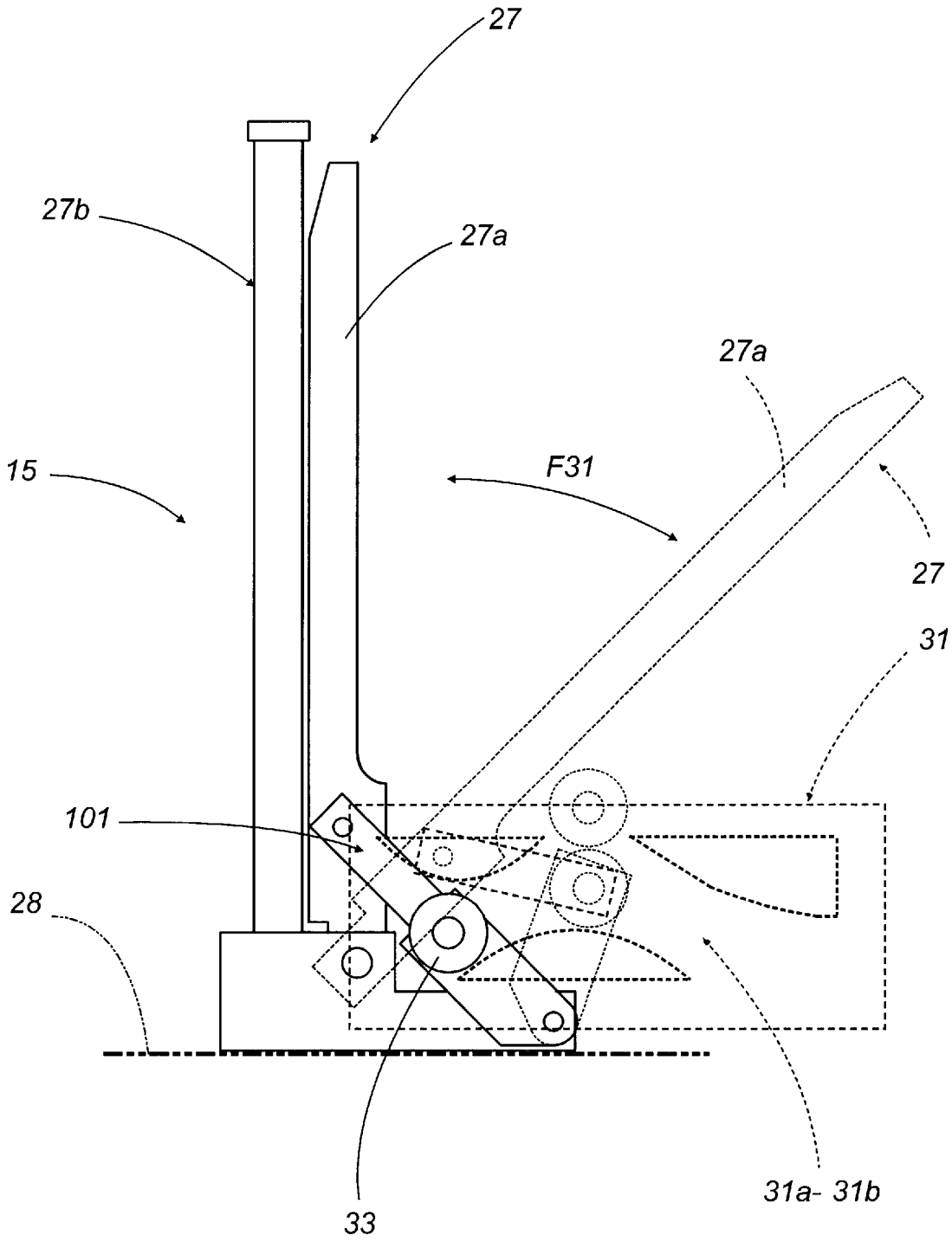
FIG. 9 is a schematic side view, with some parts cut away to better illustrate others, of the a further detail of the device illustrated in FIGS. 5, 6 and 7, that is to say, a gripper for picking up and positioning the free end of the film and the cam means.

In terms of construction details (see also FIG. 9) each cam profile 31*a* and 31*b* is mobile between relative means 32 (known cylinders, of which one is illustrated in FIG. 6), so that it moves from a distanced, non-operating position, in which the cam profiles 31*a* and 31*b* are moved away from the path P1, to a position in which it intercepts a cam follower 33 on a mobile jaw 27*a* of the pick up gripper 27 (see arrows F31), allowing the mobile jaw to move towards and away from the fixed jaw 27*b*. FIG. 9 (illustrating gripper 27 opening, although the closing movement is substantially the same, but in the opposite direction), shows how the cam follower 33 is located at a point of connection with a rocker arm 101 attached to the mobile jaw 27*a* and the base of the gripper 27, allowing movement and stabilization in the gripper 27 open and closed positions.

Returning to the wrapping unit 7, FIGS. 2 and 3 illustrate film 2 tensioning means 17 close to the reel 1. Said means act on the new reel 1. These are designed to allow recovery of the film 2 when the new reel 1 is moved towards the pre-stretching rollers 9 and 10.

The film 2 tensioning means 17 are needed because the film 2 extending from the gripper 27 along the path also includes the portion of film 2 from the new reel 1 in its position distanced from the pre-stretching in its position distanced from the pre-stretching rollers 9 and 10, therefore, moving the new reel 1 towards the rollers 9 and 10 would crush any excess film 2.

The tensioning means 17 consist of at least one cylinder 37 which turns freely, with a vertical axis and supported by the wrapping unit 7. The cylinder is positioned along the arched trajectory labeled T, defined by the new reel 1, where the reel is moved towards the pre-stretching rollers 9 and 10 (again done by the above-mentioned gripper element 36), so that it intercepts the outer surface of the new reel 1 and allows the latter to rotate in the opposite direction to recover part of the film 2 already unwound by the pick up gripper 27.

For improved safety, the wrapping unit 7 is equipped with at least two cylinders 37 and 38 which rotate freely, attached to the wrapping unit 7 independently of one another and positioned one after another along the trajectory T in such a way that they both allow a correct counter-rotation to allow the new reel 1 to correctly recover the film 2 unwound.

Each cylinder 37 and 38 also has a cylindrical surface which makes contact with the new reel 1 with a high friction coefficient, to determine safe and correct reel rotation.

Since some movement of both the wrapping unit 7 and the ring 5 is required in order to position the shaft 8 correctly relative to the gripper element 36, the first pick up means 13 and the magazine 14 and in order to correctly lower and raise the shaft 8 to release the finished reel 1*e* and pick up the new reel 1, there are means 39 which control the position of the wrapping unit 7, operating between the wrapping unit 7 and the support ring 5, and means 40 which control the height of the ring 5 relative to the column 6.

Said means 39 and 40 are schematically illustrated as blocks in FIG. 1, since they are elements already known in this sector, such as optical or mechanical position sensors, suitably distributed on the ring 5 and/or on the column 6.

To summarize, the reel is change as follows, starting with a situation in which the reel is finished and with the wrapping unit 7 suitably positioned close to the gripper element 36.

The latter, moving along two axes X and Y, allows the rotation which moves the shaft 8 away from the rollers 9 and 10 (see FIGS. 2 and 3).

Upon completion of this operation, the unit 7 turns and moves to a suitable position for pick up of the finished reel 1*e*.

While this happens, the unit 12 moves on the carriage 18 to the unit 7 with the cup-shaped element 19 below the finished reel 1*e*. The unit 7 is lowered to allow the release of the finished reel 1*e* from the shaft 8 and the reel is picked up by the pick up unit 20. The next time the ring 5 is raised, the reel 1*e* is completely removed from the shaft 8.

The unit 7 then turns again, bringing the shaft 8 above a new reel 1 already suitably positioned by the carrousel 25. Once in position, the ring 5 is lowered again so that the shaft 8 is connected to the new reel 1.

Once the shaft 8 and new reel 1 are stably connected, the gripper 27 is activated and picks up the free end 2*a* of the film 2 from the reel just connected and, by means of the gear wheels 30, unwinds the film 2 along the path P followed by the film 2 during normal use in product 3 wrapping. In addition to the path P, the gripper 27 moves over a further section so as to reach and partially wind around the above-mentioned gripper element 100 (see FIG. 9).

When the free end 2*a* has been grasped by the gripper element 100, and the gripper 27 has released said free end, the wrapping unit 7 is raised again, by means of the ring 5, to the starting position close to the gripper element 36. By moving in the opposite direction, the latter moves the new reel 1 close to the pre-stretching rollers 9 and 10 again, whilst the cylinders 37 and 38 allow the new reel 1 to recover the excess film 2. At this point the unit 7 may begin wrapping again, whilst the unit 12 moves away from the ring 5 operating zone.

This description illustrates how the device disclosed fulfils the preset aims with a compact, linear structure and rapid reel substitution on the wrapping unit. The device requires operator attention only to place new reels on the carrousel and position the free end on the fixed gripper. Reel change-over times are, therefore, greatly reduced and the operations do not directly involve personnel, ensuring that their workload is not excessive.

The present invention may be subject to numerous variations, all encompassed by the original design concept. Moreover, all parts may be substituted with technically equivalent elements.

What is claimed is:

1. A device for automatically changing reels of film for wrapping products; the reels of film being used on machines for wrapping products on pallets, the machines comprising a ring structure, means to move the ring structure vertically in both directions along a support column; the ring being equipped with a product wrapping unit which is mobile along the ring to allow the spiral wrapping of the product; the product wrapping unit comprising at least a reel support shaft, one pair of film pre-stretching rollers located close to the shaft, and at least one feed roller designed to define a preset film path from the reel to the product to be wrapped, the device comprising, at a base of the machine, a unit which replaces a finished reel with a new reel, the unit which replaces a finished reel with a new reel, movable between a non-operating position in which it is distanced from a ring operating zone, and an operating position in which it is close to the operating zone and the wrapping unit, and comprising: first pick up means which also detach the finished reel from the shaft; a magazine zone with at least one new or replacement reel which can be stably attached to the support shaft; second pick up means for the free end of the film from the replacement reel, being mobile along a path which covers the preset film path, allowing the film to be positioned close to the product to be wrapped.

2. The device according to claim 1, wherein drive means operate upon the shaft, and are designed to move the shaft away from the pre-stretching rollers when the finished reel is substituted with the new reel and, respectively, to move the shaft towards the pre-stretching rollers when the reel change-over is complete.

3. The device according to claim 1, wherein the wrapping unit comprises film tensioning means, said means acting upon the new reel and designed to allow recovery of the film when the new reel is moved towards the pre-stretching rollers.

4. The device according to claim 1, wherein the unit which replaces a finished reel with a new reel is equipped with a motor-driven support carriage which slides in both directions, positioning itself below the ring and close to the wrapping unit.

5. The device according to claim 1, in which the reel support shaft is fitted with a pair of retaining elements for the reel, said elements turning between a position in which they lock the reel in place, in which the elements project in a radial direction from the base of the shaft, and a release position, in which the elements are turned towards the shaft, wherein the first pick up and detachment means for the finished reel comprise a cup-shaped element for releasing the retaining elements and a pick up unit for the finished reel, being designed to allow removal of the reel from the shaft.

6. The device according to claim 5, wherein the cup-shaped element and the pick up unit are supported by a single column and rotate independently of one another about a single vertical axis between a position in which they are distanced from the shaft and a position in which they are close to the shaft.

7. The device according to claim 5, wherein the size and shape of the inside of the cup-shaped element are such that, when in the position close to the shaft, it houses the lower part of the shaft and finished reel, by means of a vertical movement of the support ring, allowing the retaining elements to move to the release position.

8. The device claim 5, wherein the pick up unit consists of a gripper comprising two independent jaws, set opposite one another and shaped in such a way that they surround the finished reel; the jaws being attached to an endless chain wound around two gear wheels and driven in such a way as to allow movement of the jaws towards and away from each other.

9. The device according to claim 1, wherein the magazine zone comprises a carrousel which rotates about its vertical axis and which is designed to allow co-axial positioning of the new reel and the support shaft; the carrousel comprising at least two vertical support pins for new reels and means for moving the pins vertically in both directions between a raised operating position in which they support the reel, and a lowered non-operating position, simultaneous with lowering of the shaft, so that the new reel is connected to the shaft.

10. The device according to claim 1, wherein, for each new reel, the carrousel comprises a fixed gripper for positioning the free end of the film in a zone in which it is intercepted by the free end pick up means when the new reel is attached to the shaft.

11. The device according to claim 1, wherein the second pick up means comprise a gripper for picking up the free end, the gripper being attached to an endless, motor-driven chain which extends along a horizontal surface of the unit; the chain extends along the path covering the preset film path over a plurality of drive gear wheels, with which the chain meshes, the gear wheels being suitably positioned along the horizontal surface in such a way as to partially cover the surfaces of the rollers on the wrapping unit.

12. The device according to claim 1, wherein the unit which replaces a finished reel with a new reel is equipped with cam means acting on the pick up gripper and located at points close to the path followed by the gripper, allowing gripper closing to pick up the free end and, respectively, gripper opening at an end zone of the preset film path.

13. The device according to claim 12, wherein the cam means consist of two cams, the first, closing cam being positioned in such a way that it can be inserted between the magazine and the horizontal surface, close to the fixed gripper for positioning the free end, the second, opening cam positioned at an end zone of the path followed by the pick up gripper.

14. The device according to claim 12, further comprising means for moving each of the cam profiles vertically in both directions from a lowered, non-operating position, in which the cam profiles are below the horizontal surface, to a position in which the cam profiles project above the surface and intercept a cam follower on a mobile jaw of the pick up gripper, allowing the mobile jaw to turn and move towards and away from the fixed jaw.

15. The device according to claim 2, wherein the shaft drive means comprise a horizontal arm which pivots on the wrapping unit and to which the shaft is also attached; the free end of the arm being fitted with a pin which can engage with a gripper element on the vertical column, mobile along two controlled axes and designed to allow the arm to rotate in such a way that it moves the shaft with the finished reel away from and, respectively, moves the shaft with the new reel towards the pre-stretching rollers.

16. The device according to claim 3, wherein the film tensioning means consist of at least one cylinder which turns freely, having a vertical axis and supported by the wrapping unit, the cylinder being positioned along the arched trajectory defined by the new reel, where the reel is moved towards the pre-stretching rollers, intercepting the outer surface of the new reel and allowing the latter to rotate in such a way as to recover part of the film already unwound by the pick up gripper.

17. The device according to claim 1, wherein the wrapping unit is equipped with at least two cylinders which rotate freely, being attached to the wrapping unit independently of one another and positioned one after another along the trajectory in such a way that they both allow said rotation of the new reel to recover the film unwound.

18. The device according to claim 17, wherein each free turning cylinder has a cylindrical surface with a high friction coefficient which makes contact with the new reel.

19. The device according to claim 1, comprising means for controlling the position of the wrapping unit, operating between the wrapping unit and the support ring to allow correct positioning of the shaft relative to the magazine and of the wrapping unit relative to the horizontal surface.

20. The device according to claim 1, comprising means for controlling the height of the ring during the detachment of the finished reel and the pick up of the new reel.

21. An apparatus for wrapping products on a pallet with film dispensed from a reel, said apparatus comprising:

a ring structure;

a support column;

means for moving the ring structure vertically in first and second opposite directions along the support column;

a product wrapping unit movably connected to the ring structure and mobile along the ring to allow the spiral wrapping of the product;

a reel support shaft;

film pre-stretching rollers located close to the reel support shaft;

at least one feed roller defining a preset film path from an associated reel of film to the product to be wrapped;

a reel replacing unit for automatically changing an associated reel of film, said reel replacing unit comprising: first pick up means that detach an associated finished reel from the reel support shaft; a magazine zone for holding at least one associated replacement reel to be attached to the reel support shaft; second pick up means for holding and positioning an associated free end of film from the associated replacement reel; and, means for moving the reel replacement unit between a non-operating position in which the reel replacement unit is spaced from a ring operating zone, and an operating position in which the reel replacement unit is adjacent the ring operating zone.

* * * * *